US005611912A

United States Patent [19]

Han et al.

[11] Patent Number: 5,611,912

[45] Date of Patent: Mar. 18, 1997

[54] PRODUCTION OF HIGH CETANE DIESEL FUEL BY EMPLOYING HYDROCRACKING AND CATALYTIC DEWAXING TECHNIQUES

[75] Inventors: Scott Han, Lawrenceville; Roland H. Heck, Pennington; Michael E. Ehlers, Lakewood, all of N.J.

[73] Assignee: Mobil Oil Corporation, Fairfax, Va.

[21] Appl. No.: 583,700

[22] Filed: Jan. 5, 1996

Related U.S. Application Data

[63] Continuation of Ser. No. 375,749, Jan. 20, 1995, which is a continuation-in-part of Ser. No. 112,029, Aug. 26, 1993, abandoned.

[51] Int. Cl.[6] ..... C10G 47/18; C10G 73/02

[52] U.S. Cl. ..... 208/58; 208/59; 208/76

[58] Field of Search ..... 208/58, 60, 67, 208/72, 75, 76, 83, 92, 108, 109, 111

[56] References Cited

U.S. PATENT DOCUMENTS

| | | | |
|---|---|---|---|
| 3,174,925 | 3/1965 | Claussen et al. | 208/59 |
| 3,256,177 | 6/1966 | Tulleners et al. | 208/89 |
| 3,306,839 | 2/1967 | Vaell et al. | 208/59 |
| 4,283,272 | 8/1981 | Garwood et al. | 208/59 |
| 4,483,760 | 11/1984 | Tabak et al. | 208/60 |
| 4,676,887 | 6/1987 | Fischer et al. | 208/61 |
| 4,985,134 | 1/1991 | Derr, Jr. et al. | 208/89 |

OTHER PUBLICATIONS

Oil and Gas Journal, May 31, 1982 (pp. 87–94).

Petroleum Refining, Second Edition, James H. Gary/Glenn E. Handwerk (pp. 138–151).

Modern Petroleum Technology, Fourth Edition, Hobson/G.D. Applied Science Publ. 1973 (pp. 309–327).

*Primary Examiner*—Glenn A. Caldarola

*Assistant Examiner*—Bekir L. Yildirim

*Attorney, Agent, or Firm*—Malcolm D. Keen; Penny L. Prater

[57] ABSTRACT

A process for the production of diesel fuel with a high cetane number at a low cloud point, which involves hydrocracking highly aromatic fractions obtained from catalytic cracking operations. The fraction of hydrocracker effluent which boils between about 400° F. (205° C.) and 1000° F. (538° C.) is subsequently catalytically dewaxed in order to obtain a cloud point of no more than 41° F. (5° C.). The hydrocracker effluent fraction is preferably recycled to the hydrocracking step prior to dewaxing.

17 Claims, 2 Drawing Sheets

PRODUCTION OF HIGH CETANE DIESEL FUEL BY EMPLOYING HYDROCRACKING AND CATALYTIC DEWAXING TECHNIQUES

CROSS REFERENCE TO RELATED APPLICATION

This is a continuation of copending application Ser. No. 08/375,749, filed on Jan. 20, 1995, which is a CIP of 08/112,029, filed Aug. 26, 1993 abandoned.

FIELD OF THE INVENTION

This invention relates to the production of diesel fuel with a high cetane number. More particularly, it relates to the production of high cetane number diesel at less than or equal to 41° F. (5° C.) by hydrocracking highly aromatic fractions obtained from catalytic cracking operations and subsequently catalytically dewaxing the fraction boiling between about 400° F. (205° C.) and 1000° F. (538° C.) obtained from the hydrocracking process. This fraction is preferably recycled to the hydrocracking step prior to dewaxing.

BACKGROUND OF THE INVENTION

Under present conditions, petroleum refineries are finding it necessary to convert increasingly greater proportions of crude to premium fuels such as gasoline and middle distillates such as diesel and jet fuel. Due to recent environmental legislation, "clean fuels" or fuels which are low in sulfur, content combust without leaving carbon residue, and have reduced harmful emissions, are in increasing demand. Sulfur contributes to engine wear and the corrosion of mufflers and exhaust pipes. Diesel fuels, according to conventional product specifications, have a cetane number of at least 45. Cetane number is a measurement of the ignition quality of diesel fuel and is directly related to cleanliness of fuel. Diesel may be contaminated by even small amounts of dirt. A relatively high cetane number is indicative of a fuel which enables an engine to operate smoothly and easily at low temperatures. It has been discovered that diesel fuels of high cetane number, 55 or greater at less than or equal to 41° F. (5° C.) cloud-point, may be produced by hydrocracking light cycle oils from the fluid catalytic cracking process at high pressure, then catalytically dewaxing certain fractions from the hydrocracking process under low pressure.

Light cycle oil (LCO) is a highly aromatic, hydrogen-deficient middle distillate having high levels of sulfur and nitrogen. Table 1 below gives typical sulfur and nitrogen contents for a light cycle oil.

TABLE 1

| Light Cycle Oil | | | |
|---|---|---|---|
| Aromatics, pct. | S, pct. | N, ppm | H, pct. |
| 57 | 1.6 | 700 | 11.57 |

Because of its high content of aromatics and heteroatoms, LCO has been difficult to dispose of as a commercially valuable product. Formerly, the light and heavy cycle oils could be upgraded and sold as light or heavy fuel oil, such as No. 2 fuel oil or No. 6 fuel oil. Upgrading the light cycle oil was conventionally carried out by a relatively low severity, low pressure catalytic hydro-desulfurization (CHD) unit in which the cycle stock would be admixed with virgin mid-distillates from the same crude blend fed to the catalytic cracker. Further discussion of this technology is provided in the Oil and Gas Journal, May 31, 1982, pp. 87–94.

Currently, however, the refiner is finding a diminished demand for fuel oil. At the same time, the impact of changes in supply and demand for petroleum has resulted in a lowering of the quality of the crudes available to the refiner; this has resulted in the formation of an even greater quantity of refractory cycle stocks. As a result, the refiner is left in the position of producing increased amounts of poor quality cycle streams from the catalytic cracker while having a diminishing market in which to dispose of these streams.

At many petroleum refineries, the light cycle oil (LCO) from the FCC unit is a significant component of the feed to the catalytic hydrodesulfurization (CHD) unit which produces No. 2 fuel oil or diesel fuel. The remaining component is generally virgin kerosene taken directly from the crude distillation unit. The highly aromatic nature of LCO, particularly when the FCC unit is operated in the maximum gasoline mode, increases operational difficulties for the CHD and can result in a product having marginal properties for No. 2 fuel oil or diesel oil, as measured by cetane numbers and sulfur content.

In the past there have been difficulties in employing LCO in the preparation of diesel fuel. Diesel fuel must meet a minimum cetane number specification of about 45 in order to operate properly in typical automotive diesel engines. Because cetane number correlates closely and inversely with aromatic content, the highly aromatic cycle oils from the cracker typically with aromatic contents of 80% or even higher have cetane numbers as low as 4 or 5. In order to raise the cetane number of these cycle stocks to a satisfactory level by the conventional CHD technology described above, substantial and uneconomic quantities of hydrogen and high pressure processing would be required.

Because of these problems associated with its use as a fuel, recycle of untreated light cycle oil to the FCCU has been proposed as a method for reducing the amount of LCO. Benefits expected from the recycle of LCO include conversion of LCO to gasoline, backout of kerosene from No. 2 fuel oil and diminished use of cetane improvers in diesel fuel. However, in most cases, these advantages are outweighed by disadvantages, which include increased coke make in the FCC unit, diminished quality of the resultant LCO and an increase in heavy cycle oil and gas.

A typical LCO is such a refractory stock and of poor quality relative to a fresh FCC feed that most refineries do not practice recycle of the untreated LCO to any significant extent. One commonly practiced alternative method for upgrading the LCO is to hydrotreat severely prior to recycle to the catalytic cracker or, alternatively, to hydrotreat severely and feed to a high pressure fuels hydrocracker. In both such cases, the object of hydrotreating is to reduce the heteroatom content to low levels while saturating polyaromatics to increase crackability. In those instances where the production of gasoline is desired, the naphtha may require reforming to recover its aromatic character and meet octane specifications.

Hydrocracking may be used to upgrade the higher-boiling more refractory products derived from catalytic cracking. The catalytic cracker is used to convert the more easily cracked paraffinic gas oils from the distillation unit while the hydrocracker accepts the dealkylated, aromatic cycle oils from the cracker and hydrogenates and converts them to lighter oils. See Petroleum Refining; Second Ed.; Gary, J. H. and Handwerk, G. E.; Marcel Dekker, New York 1984; pp.

138–151; Modern Petroleum Technology, Fourth Ed.; Hobson, G. D., Applied Science Publ. 1973; pp. 309–327. A notable advance in the utilization of FCC cycle oils is described in U.S. Pat. No. 4,676,887. It was found that highly aromatic, refractory feeds derived from catalytic cracking could be converted directly to high octane gasoline by hydrocracking at relatively low pressures, typically 600–1000 psig (about 4250–7000 kPa. abs.) and with low conversions, typically below 50 weight percent to 385° F. (195° C.) products. By using a highly aromatic feed which has been substantially dealkylated in the catalytic cracking operation, typically with an API gravity of 5–25, the hydrocracking proceeds with only a limited degree of aromatics saturation so that a large quantity of single-ring alkylaromatics (mainly benzene, toluene, xylenes and trimethyl benzenes) are obtained by ring opening of partial hydrogenation products of bicyclic aromatics. The single ring aromatics are not only in the gasoline boiling range but also possess high octane numbers so that a high octane gasoline is produced directly, suitable for blending into the refinery gasoline pool without prior reforming.

Hydrocracking is, however, not well adapted to the production of high cetane diesel, as opposed to gasoline because the hydrocracked product contains significant amounts of iso-paraffins produced by isomerization and ring opening reactions characteristic of hydrocracking. While iso-paraffins are conducive to high octane ratings in gasoline they tend to lower the cetane number of diesel fuels (See Modern Petroleum Refining, Hobson). These difficulties apply with particular force in high pressure hydrocracking in which these reactions are favored. In addition, diesel fuel from hydrocracking, particularly in the higher boiling fractions, tends to have poor cold flow properties (e.g. pour, cloud, freeze points) due to the large amount of long chain paraffinic components. These properties deleteriously affect diesel fuel potential by limiting distillate yields and producing fuel outside of conventional specifications. For these reasons, high pressure hydrocracking has not been considered as an appropriate process for the production of high cetane number diesel fuel. Hydrocracker processes of this type are described, for example, in U.S. Pat. No. 3,306,839, issued to Vaell, which discloses a gas oil feed passing through a hydrotreater. It is then cascaded to a first stage hydrocracker. The hydrocracked effluent passes to a first stage high pressure separator and then to a common low pressure separator. The first stage hydrogen circuit is provided with recycle hydrogen from the first stage high pressure separator. The stream from the low pressure separator goes to the fractionator with the bottoms fraction being passed to the second stage hydrocracker together with recycle hydrogen from the second stage high pressure separator. The second stage high pressure separator is connected to the common low pressure separator so that the combined hydrocracked products are sent to the fractionator. U.S. Pat. No. 3,256,177, issued to Tulleners,discloses an arrangement similar to that of Vaell. A gas oil feed passes to a high pressure hydrotreater with its effluent cascaded to a first stage hydrocracker. First stage hydrocracker effluent passes to the high pressure separator and low pressure separator and then to the fractionator. Under one process alternative the fractionator bottoms passes to a second stage hydrocracker after mixing with fresh hydrogen and preheating. Separate second stage high pressure separators and low pressure separators are provided and the condensate from the low pressure separator is returned to the fractionator.

U.S. Pat. No. 3,174,925, issued to Claussen, also discloses two stage hydrocracking with bottoms feed to the second stage.

U.S. Pat. No. 4,985,134, issued to Derr, et al. is directed to the production of both gasoline and middle distillate fractions. Primarily gasoline boiling range products are to be produced in Derr, et al., since claim 1 recites conversion to such products of no more than 75%. Derr et al, furthermore operates at low pressure, since claim 1 of Derr, et al. specifically states that the hydrogen partial pressure is to be below 1200 psig. The instant invention, on the other hand, is directed to high pressure operation.

Gasoline may be produced in the hydrocracking step of the instant invention, but only as a by-product. Derr et al is directed to the deliberate production of both gasoline and diesel products.

Applicants seek to maximize the production of high cetane diesel fuel. Derr et al. actually teaches away from the instant application. Table 2 of Derr et al. indicates that the cetane index of the distillate fraction produced in Derr et al (between 35 and 38) is far below the cetane number of the instant invention. The instant invention employs a cetane number of at least 55 at less than or equal to 5° C. cloud point. Derr et al. does not discuss cloud point. Cetane number is an experimentally measured characteristic, using ASTM engine test D 613. Cetane Index is a calculated value which is known in the art of diesel production. Cetane Index approximates Cetane Number, using API gravity and mid-boiling point. The results are quite close to those obtained by direct experimental measurement. Cetane number and cetane index are therefore comparable. Derr et al states (col. 4, lines 47–50) that the distillate of its invention has a very low cetane blending value, making it unacceptable for use as a road diesel fuel. This is not true for the distillate of the instant invention.

Furthermore, there is no teaching in Derr, et al of catalytic dewaxing of the hydrocracker effluent. The primary product of Derr, et al. is gasoline, and the presence of substantial quantities of wax in a light, volatile fraction such as gasoline is unlikely.

The instant invention comprises a high pressure hydrocracking process in which the primary product is high quality diesel fuel. Derr et al. is a low pressure hydrocracking process directed to the production of gasoline and distillate products which are not road quality diesel.

U.S. Pat. No. 4,483,760, issued to Tabak et al, is directed to the production of middle distillates and fuel oils, which are heavier than diesel fuels. Tabak et al indicates (col. 2, lines 26–28) that its catalytic dewaxing process may be used to lower unacceptably high pour points. The instant invention is not directed to the lowering of pour points or cloud points. The instant invention seeks to maximize cetane number. FIG. 2 of the instant application illustrates a direct relationship between cloud point and cetane number. The higher the cloud point, the higher the cetane number. The instant invention permits cloud points as high as 5° C., which is 41° F., so that cetane number can be as high as possible. Tabak et al does not discuss cetane number because it is a diesel characteristic and Tabak et al is directed to fuel oils. Tabak et al. is so concerned with pour point that it comprises contacting a dewaxing by-product with a dewaxing catalyst a second time in order to obtain an increased yield of dewaxed fuel oil.

SUMMARY OF THE INVENTION

It has been found that diesel with a high cetane number at less than or equal to 41° F.(5° C.) cloud point may be produced by the catalytic dewaxing of the fraction of the effluent from the high pressure hydrocracking operation which boils in the range from about 400° F. (205° C.) to 1000° F. (538° C.). Although the dewaxing of the fraction directly following hydrocracking produces a diesel with higher cetane numbers than at constant cloud points those obtained when conventional feeds to the catalytic dewaxer (such as gas oils) are employed, it is notable that cetane numbers further improve if the hydrocracker effluent fraction is recycled to the hydrocracker.

Accordingly, the present invention is directed to a process for the high pressure hydrocracking of highly aromatic, substantially dealkylated feedstocks, followed by low pressure catalytic dewaxing of the fraction of hydrocarbon effluent in the ca 400° (205° C.)–1000° F. (538° C.) boiling range. This effluent may have been recycled through the hydrocracking step.

The feeds used in the hydrocracking step may typically be either a full range cycle oil as described in U.S. Pat. No. 4,676,887 or, alternatively, a light cut cycle oil as described in U.S. Pat. No. 4,738,766. If the light cut cycle oils are employed, higher conversion levels may be tolerated in the hydrocracking step as described in U.S. Pat. No. 4,738,766.

The hydrocracking step (or steps if extinction recycle is used) is operated under high pressure, typically 1500 (10343kPa)-3000 psig (20685kPa). The temperature range is 500° F. (260° C.)–800° F.(427° C.), and the LHSV (liquid hourly space velocity) is 0.5–2.0 vol/vol/hr. The hydrogen circulation range is 1000–3000 SCF/BBL and conversion to gasoline is 30–100%.

The catalytic dewaxing step is operated under lower pressure, from about 200 (1482 kPa) to about 800 psig (5619kPa). The temperature is from 400° (205° C.) to 1000° F. (538° C.), and the LHSV is from 0.5 to 2.5 vol/vol/hr. The hydrogen circulation rate is from 1000 to 3000 SCF/BBL.

DETAILED DESCRIPTION OF THE PREFERRED EMBODIMENT

Hydrocracking

Figure 1:
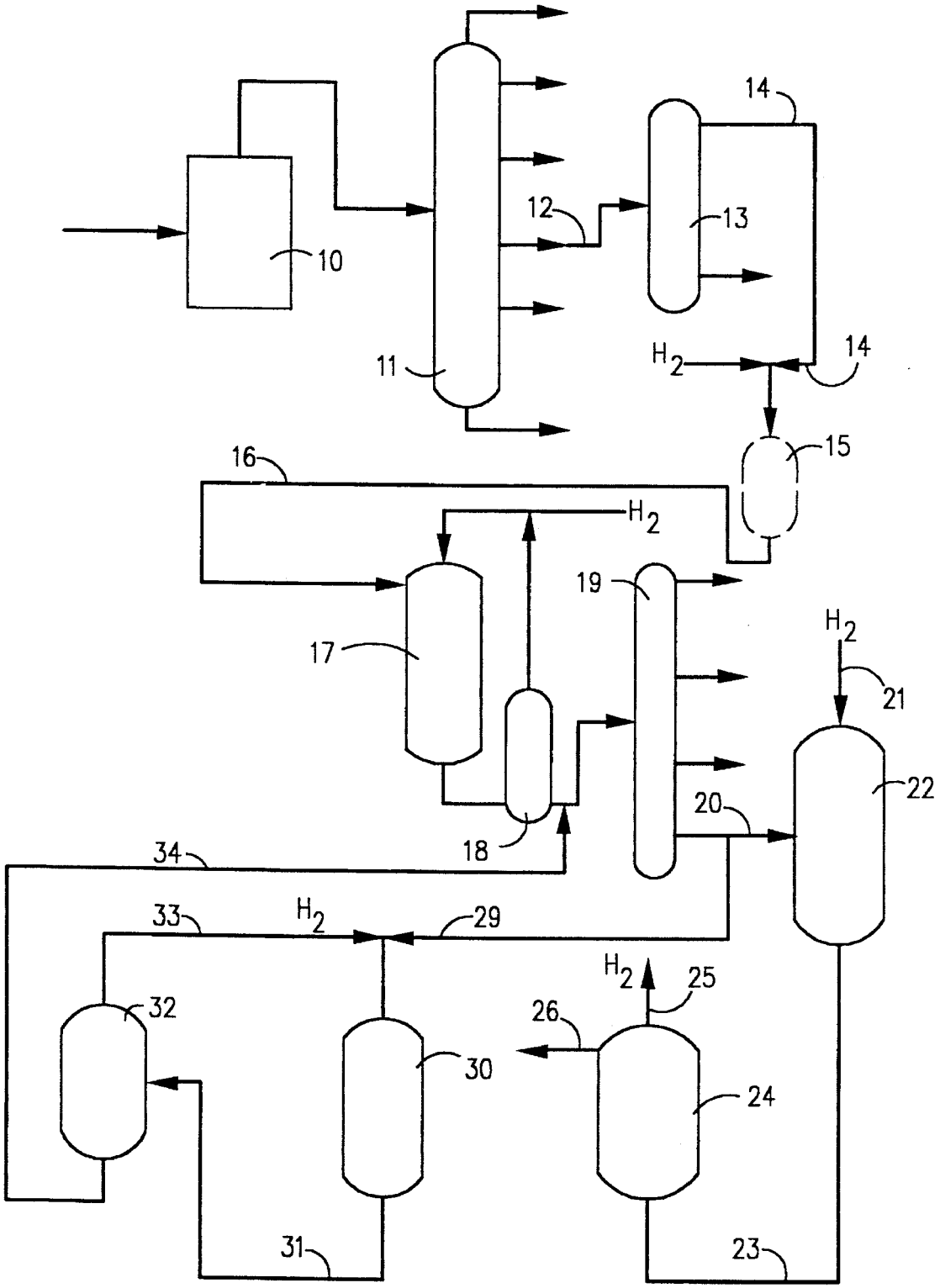
FIG. 1 of the accompanying drawings is a simplified schematic illustration of a process unit for producing diesel by the process of this application.

A preferred process configuration using a light cut LCO feed to the hydrocracker is illustrated schematically in FIG. 1. A gas oil or resid feed to an FCC unit 10 is cracked in the FCC unit and the cracking products are fractionated in the cracker fractionator 11 to produce the various hydrocarbon fractions which leave the fractionator in the conventional manner. A full range light cycle oil (FRLCO) is withdrawn from fractionator 11 through draw-off conduit 12 and is subjected to a secondary fractionation in distillation tower 13. The lower boiling fraction with a boiling range greater than 235° F. (113° C.) preferably with a boiling range greater than about 400° F. (205° C.) (see Table 4), is withdrawn through conduit 14 and this light cut LCO (LCLCO) is then passed to hydrocracker 17. As discussed below, the LCO may be hydrotreated in hydrotreater 15 before being passed through line 16 to hydrocracker 17. Alternately this fractionation can be done on the main FCC column itself. The higher boiling fraction of the cycle oil withdrawn from the bottom of fractionator 13 may be blended into fuel oil products in the conventional way, either directly or after catalytic hydrocracking treatment. In the hydrocracker, the typical hydrocracking reactions take place with saturation of the aromatics and ring opening and cracking to form a hydrocracked product which is rich in monocyclic aromatics in the gasoline boiling range. After hydrogen separation in separator 18, the hydrocracker effluent is fractionated in the conventional manner in distillation tower 19 to form the products including dry gas, gasoline, middle distillate and a bottoms fraction boiling in the range from 400°–1000° F. (205°–538° C.). The bottoms fraction may be sent directly to catalytic dewaxer 22 via line 20 or may be recycled one or more times through second stage hydrocracker 30.

Hydrocracker 17 is operated at high pressure and employs feed having significant amounts of higher boiling (e.g. 600° F.+) fractions. It is therefore preferred that a preliminary hydrotreating step be carried out in hydrotreater 15 before the hydrocracker to effect some saturation of aromatics, especially PNAs, as well as to hydrogenate residual heteroatoms, especially nitrogen and sulfur which are then removed in an interstage separator. However, the hydrocracking step will itself carry out a substantial degree of hydrogenation so that the operation of the catalytic cracking step will be improved by the hydrogenation which takes place there rendering the initial hydrotreating step unnecessary although it may be used if desired. Preliminary hydrotreating is usually carried out in cascade in the hydrocracker 17 without interstage separation before the hydrocracking step.

Extinction Recycle

The recycle feed in this invention may be obtained from a hydrocracker which recycles its heavier fractions "to extinction". In such a situation, the heavier fractions are recycled until they are totally converted to desirable products. Nothing remains as bottoms or asphalt. The products of the hydrocracker 17, the first stage hydrocracker, pass directly into high pressure separator 18, where hydrogen, hydrogen sulfide, and ammonia are removed. The hydrocarbon cracking products are then subjected to fractionation in low pressure separator 19 to produce light gas, gasoline, distillate and heavy ends. The heavy ends may at this point pass directly to catalytic dewaxer 22 or second stage hydrocracker 30. The effluent from this hydrocracker is passed through line 31 to the high pressure separator 32, where hydrogen, hydrogen sulfide and ammonia are removed. The hydrogen may be returned through conduit 33 to the second stage hydrocracker. The heavier hydrocarbons are then returned to low pressure separator 19. The heavy ends may be essentially "recycled to extinction" in this arrangement, i.e., recycled as much as necessary to produce a feed suitable for the catalytic dewaxer. The fresh feed is subjected to hydrocracking in the first stage hydrocracker while the second stage hydrocracker is employed for the hydrocracking of the heavy ends which are not converted in the first stage.

Catalytic Dewaxing

The hydrocracked effluent separated in low pressure separator 19 is passed via line 20 to catalytic dewaxing section 22 along with makeup hydrogen introduced via line 21. It is important to note for purposes of this invention that the only hydrogen supplied to the catalytic dewaxer section 22 is fresh hydrogen having a hydrogen sulfide partial pressure of less than about 5 psia and less than 100 ppm of ammonia. The amount of hydrogen supplied via line 21 may be up to about the amount consumed in the process. Thus, all of the makeup hydrogen may be supplied via line 21. Alternatively, if it is desired to supply to the catalytic dewaxer 22 less than the makeup requirement of the system, the remainder may be supplied to the hydrocracker.

The effluent from the catalytic dewaxer, including excess hydrogen may be via line 23 to a high pressure separation section 24 wherein it is treated to separate light hydrocarbons, which are removed together with a hydrogen bleed via line 25. Also separated is the hydrocarbon mixture comprising a stabilized and dewaxed hydrocracked lubricating stock, which is recovered via line 26. The hydrocarbon mixture containing the lubricating oil stock is passed via line 26 to another unit for recovery of the lubricating oil stock, which other unit is not part of this invention.

Hydrocracking Conditions

The hydrocracking of the instant invention takes place at high pressure, at least 1000 psig, preferably 1500–3000 psig, (10343–20685 kPa) with the exact pressure selected being dependent upon feed characteristics (aromatic and heteroatom content), catalyst stability and aging resistance and the desired product characteristics. This is particularly the case with light cut LCO feeds which are principally composed of bicyclic aromatics such as naphthalene, benzothiophene, etc. where excessive saturation is definitely not desired. The temperature range is 500–800 (260°–427° C.) and the LHSV (liquid hourly space velocity) is 0.5–2.0 vol/vol/hr. The hydrogen circulation range is 1000–3000 SCF/BBL, and conversion to gasoline is 30–100%.

When operating with a full boiling range feed, e.g., a full range LCO, it is necessary to operate under certain pressure-conversion regimes in order to obtain extended catalyst cycle life between successive regenerations. Hydrogen partial pressures typically as high as 3000 psig may be used.

Feedstock to the Hydrocracker

The feeds used in the present process are hydrocarbon fractions which are highly aromatic and hydrogen deficient, as well as low in cetane number.

They are fractions which have been substantially dealkylated, as by a catalytic cracking operation, for example, in an FCC or TCC unit. It is a characteristic of catalytic cracking that the alkyl groups, generally bulky, relatively large alkyl groups (typically but not exclusively $C_5$–$C_9$ alkyls), which are attached to aromatic moieties in the feed become removed during the course of the cracking. It is these detached alkyl groups which lead to the bulk of the gasoline product from the cracker. The aromatic moieties such as benzene, naphthalene, benzothiophenes, dibenzothiophenenes and polynuclear aromatics (PNAs) such as anthracene and phenanthrene form the high boiling products from the cracker. The mechanisms of acid-catalyzed cracking and similar reactions remove side chains of greater than 5 carbons while leaving behind short chain alkyl groups, primarily methyl, but also ethyl groups on the aromatic moieties. Thus, the "substantially dealkylated" cracking products include those aromatics with small alkyl groups, such as methyl, and ethyl, and the like still remaining as side chains, but with relatively few large alkyl groups, i.e., the $C_5$–$C_9$ groups, remaining. More than one of these short chain alkyl groups may be present, for example, one, two or more methyl groups.

Feedstocks of this type typically have an aromatic content in excess of 30 wt. percent; for example, 50 wt. percent or 60 wt. percent or more, aromatics. Highly aromatic feeds of this type typically have hydrogen contents below 14 wt. percent, usually below 12.5 wt. percent or even lower, e.g. below 10 wt. percent or 9 wt. percent. The API gravity is also a measure of the aromaticity of the feed, usually being below 30 and in most cases below 25 or even lower, e.g. below 20. In most cases the API gravity will be in the range 5 to 25 with corresponding hydrogen contents from 8.5–12.5 wt. percent. Sulfur contents are typically from 0.5–5 wt. percent and nitrogen from 50–1000 ppmw, more usually 50–700 ppmw.

Suitable feeds for the present process are substantially dealkylated cracking product fractions. Suitable feeds of this type include cycle oils from catalytic cracking units. Full range cycle oils may be used, for example, full range light cycle oils which boil above 235° F., preferably above 400° F. Heavy cycle oil or light cycle oil fractions as described in Ser. Nos. 825,294 and 940,382, may also be used.

If a cycle oil fraction is to be used, it may be obtained by fractionation of a FRCO or by adjustment of the cut points on the cracker fractionation column. The light stream will retain the highly aromatic character of the catalytic cracking cycle oils (e.g. greater than 50% aromatics by silica gel separation) but the lighter fractions used will generally exclude the heavier polynuclear aromatics (PNAs—three rings or more) which remain in the higher boiling range fractions so that higher conversions may be attained without excessive catalyst aging. In addition, the heteroatom contaminants are concentrated in the higher boiling fractions so that the hydrocracking step is operated substantially in their absence and preliminary feed hydrotreating is not necessary.

Hydrocracking Catalysts

The catalyst used for the hydrocracking is typically a bifunctional, heterogeneous, porous solid catalyst possessing acidic and hydrogenation-dehydrogenation functionality. Because the highly aromatic feed contains relatively bulky bicyclic and polycyclic components the catalyst may have a pore size which is sufficiently large to admit these materials to the interior structure of the catalyst where cracking can take place. A pore size of at least about 7.4A (corresponding to the pore size of the large pore size zeolites X and Y) is sufficient for this purpose but because the end point of the feed is limited, the proportion of bulky, polynuclear aromatics is quite low and for this reason, very large pore sizes greatly exceeding those previously mentioned are not required. Crystalline zeolite catalysts which have a relatively limited pore size range, as compared to the so-called amorphous materials such as alumina or silica-alumina, may therefore be used to advantage in view of their activity and resistance to poisoning. Catalysts having aromatic selectivity, i.e. which will crack aromatics in preference to paraffins are preferred because of the highly aromatic character of the feed.

The preferred hydrocracking catalysts are the crystalline catalysts, generally the zeolites, and, in particular, the large pore size zeolites having a Constraint Index less than 2 (see discussion below). For purposes of this invention, the term "zeolite" is meant to represent the class of metallosilicates, i.e., porous crystalline silicates, that contain silicon and oxygen atoms as the major components. Other components are also present, including aluminum, gallium, iron, boron and the like, with aluminum being preferred in order to obtain the requisite acidity. Minor components may be present separately, in mixtures in the catalyst or intrinsically in the structure of the catalyst.

A convenient measure of the extent to which a zeolite provides control to molecules of varying sizes to its internal structure is the Constraint Index of the zeolite. Zeolites which provide a highly restricted access to and egress from its internal structure have a high value for the Constraint Index, and zeolites of this kind usually have pores of small size, e.g., less than 5 Angstroms. On the other hand, zeolites which provide relatively free access to the internal zeolite structure have a low value for the Constraint Index and usually pores of large size, e.g., greater than 8 Angstroms. The method by which Constraint Index is determined is described fully in U.S. Pat. No. 4,016,218, to which reference is made for details of the method. A Constraint Index of less than 2 and preferably less than 1 is a characteristic of the hydrocracking catalysts used in the present process.

Constraint Index (CI) values for some typical large pore materials are shown in Table 2 below:

TABLE 2

| | Constraint Index |
|---|---|
| | CI (Test Temperature) |
| ZSM-4 | 0.5 (316° C.) (608° F.) |
| ZSM-20 | 0.5 (371° C.) (700° F.) |
| TEA Mordenite | 0.4 (316° C.) (608° F.) |
| Mordenite | 0.5 (316° C.) (608° F.) |
| REY | 0.4 (316° C.) (608° F.) |
| Amorphous Silica-Alumina | 0.6 (538° C.) (608° F.) |
| Dealuminized Y (Deal Y) | 0.5 (510° C.) (950° F.) |
| Zeolite Beta | 0.6–2 (316°–399° C.) (601–750° F.) |

The nature of the $C_1$ parameter and the technique by which it is determined admit of the possibility that a given zeolite can be tested under somewhat different conditions and thereby exhibit different Constraint Indices. Constraint Index may vary with severity of operation (conversion) and the presence or absence of binders. Other variables, such as crystal size of the zeolite, the presence of occluded contaminants, etc., may also affect the Constraint Index. It may be possible to so select test conditions, e.g., temperatures, as to establish more than one value for the Constraint Index of a particular zeolite, as with zeolite beta. A zeolite is considered to have a Constraint Index within the specified range if it can be brought into the range under varying conditions.

The large pore zeolites, i.e., those zeolites having a Constraint Index less than 2 have a pore size sufficiently large to admit the vast majority of components normally found in the feeds. These zeolites are generally stated to have a pore size in excess of 7 Angstroms and are represented by zeolites having the structure of, e.g., Zeolite Beta, Zeolite X, Zeolite Y, faujasite, Ultrastable Y (USY), Dealuminized Y (Deal Y), Mordenite, ZSM-3, ZSM-4, ZSM-18 and ZSM-20. Zeolite ZSM-20 resembles faujasite in certain aspects of structure, but has a notably higher silica/alumina ratio than faujasite, as do the various forms of zeolite Y, especially USY and De-AlY. Zeolite Y is the preferred catalyst, and it is preferably used in one of its more stable forms, especially USY or De-AlY.

Although Zeolite Beta has a Constraint Index less than 2, it does not behave exactly like a typical large pore zeolite. Zeolite Beta satisfies the pore size requirements for a hydrocracking catalyst for use in the present process but it is not preferred because of its paraffin-selective behavior.

Because they are aromatic selective and have a large pore size, the amorphous hydrocracking catalysts such as alumina and silica-alumina may be used although they are not preferred.

Zeolite ZSM-4 is described in U.S. Pat. No. 3,923,639; Zeolite ZSM-20 in U.S. Pat. No. 3,972,983; Zeolite Beta in U.S. Pat. Nos. 3,308,069 and Re 28,341; Low sodium Ultrastable Y molecular sieve (USY) is described in U.S. Pat. Nos. 3,293,192 and 3,449,070; Dealuminized Y zeolite (Deal Y) may be prepared by the method found in U.S. Pat. No. 3,442,795; and Zeolite UHP-Y is described in U.S. Pat. No. 4,401,556. Reference is made to these patents for details of these zeolite catalysts.

The alpha value is an approximate indication of the catalytic cracking activity of the catalyst compared to a standard catalyst. The alpha test gives the relative rate constant (rate of normal hexane conversion per volume of catalyst per unit time) of the test catalyst relative to the standard catalyst which is taken as an alpha of 1 (Rate Constant=0.016 $sec^{-}$). The alpha test is described in U.S. Pat. No. 3,354,078 and in J. Catalysis, 4, 527 (1965); 6, 278 (1966); and 61, 395 (1980), to which reference is made for a description of the test. The experimental conditions of the test used to determine the alpha values referred to in this specification include a constant temperature of 538° C. and a variable flow rate as described in detail in J. Catalysis, 61, 395 (1980).

Catalyst stability during the extended cycle life is essential and this may be conferred by suitable choice of catalyst structure and composition, especially silica:alumina ratio. This ratio may be varied by initial zeolite synthesis conditions, or by subsequent dealuminization as by steaming or by substitution of frame work aluminum with other trivalent species such as boron, iron or gallium. Because of its convenience, steaming is a preferred treatment. In order to secure satisfactory catalyst stability, high silica:alumina ratios, e.g. over 20:1 are preferred, these may be attained by steaming. The alkali metal content should be held at a low value, preferably below 1% and lower, e.g. below 0.5% Na. This can be achieved by successive sequential ammonium exchange followed by calcination.

Zeolites with a silica-to-alumina mole ratio of at least 3:1 are useful, for example, zeolite Y. It is preferred to use zeolites having much higher silica-to-alumina mole ratios, i.e., ratios of at least 20:1, as in zeolite USY. The silica-to-alumina mole ratio referred to may be determined by conventional analysis. This ratio is meant to represent, as closely as possible, the ratio in the rigid anionic framework of the zeolite crystal and to exclude aluminum in the binder or in cationic or other forms within the channels.

The zeolites are preferably composites with a matrix comprising another material resistant to the temperature and other conditions employed in the process. The matrix material is useful as a binder and imparts greater resistance to the catalyst for the severe temperature, pressure and reactant feed stream velocity conditions encountered in the process. Useful matrix materials include both synthetic and naturally occurring substances, such as clay, silica and/or metal oxides. The latter may be either naturally occurring or in the form of synthetic gelatinous precipitates or gels including mixtures of silica and metal oxides such as alumina and silica-alumina. The matrix may be in the form of a co-gel. Naturally occurring clays which can be composites with the zeolite include those of the montmorillonite and kaolin families. Such clays can be used in the raw state as originally mined or initially subjected to calcination, acid treatment or chemical modification. The relative proportions of zeolite component and the matrix, on an anhydrous basis, may vary widely with the zeolite content ranging from between about 1 to about 99 wt %, and more usually in the range of about 5 to about 80 wt % of the dry composite. If the feed contains greater than 20% 650° F.+ material, that the binding matrix itself be an acidic material having a substantial volume of large pore size material, not less than 100A°. The binder is preferably composites with the zeolite prior to treatments such as steaming, impregnation, exchange, etc., in order to preserve mechanical integrity and to assist impregnation with non-exchangeable metal cations.

The original cations associated with each of the crystalline silicate zeolites utilized herein may be replaced by a wide variety of other cations, according to conventional techniques. Typical replacing cations including hydrogen, ammonium and metal cations, including mixtures of these cations. Useful cations include metals such as rare earth metals, e.g., manganese, as well as metals of Group IIA and B of the Periodic Table, e.g., zinc, and Group VIII of the Periodic Table, e.g., platinum and palladium, to promote stability (as with the rare earth cations) or a desired functionality (as with the Group VI or VIII metals). Typical ion-exchange techniques are to contact the particular zeolite with a salt of the desired replacing cation. Although a wide variety of salts can be employed, particular preference is given to chlorides, nitrates and sulfates. Representative ion-exchange techniques are disclosed in a wide variety of patents, including U.S. Pat. Nos. 3,140,249; 3,140,251; and 3,140,253.

The hydrocracking catalyst also has a metal component to provide hydrogenation-dehydrogenation functionality. Suitable hydrogenation components include the metals of Groups VIA and VIIIA of the Periodic Table (IUPAC Table) such as tungsten, vanadium, zinc, molybdenum, rhenium, nickel, cobalt, chromium, manganese, or a noble metal such as platinum or palladium, in an amount between 0.1 and about 25 wt %, normally 0.1 to 5 wt % especially for noble metals, and preferably 0.3 to 3 wt %. This component can be exchanged or impregnated into the composition, using a suitable compound of the metal. The compounds used for incorporating the metal component into the catalyst can usually be divided into compounds in which the metal is present in the cation of the compound and compounds in which it is present in the anion of the compound. Compounds which contain the metal as a neutral complex may also be employed. The compounds which contain the metal in the ionic state are generally used, although cationic forms of the metal, e.g. Pt $(NH_3)_4^{2+}$, have the advantage that they will exchange onto the zeolite. Anionic complex ions such as vanadate or metatungstate which are commonly employed can however be impregnated onto the zeolite/binder composite without difficulty in the conventional manner since the binder is able to absorb the anions physically on its porous structure. Higher proportions of binder will enable higher amounts of these complex ions to be impregnated. Thus, suitable platinum compounds include chloroplatinic acid and various compounds containing the platinum amine complex. Phosphorus is generally also present in the fully formulated catalyst, as phosphorus is often used in solutions from which base metals, such as nickel, tungsten and molybdenum, are impregnated onto the catalyst.

Base metal components, especially nickel-tungsten and nickel-molybdenum are particularly preferred in the present process.

Catalytic Dewaxing Catalysts

The catalytic dewaxing step, as directed to lubricating oils rather than diesel fuel, is described in U.S. Pat. No. 4,283,272. U.S. Pat. No. Re. 28,398 to Chen et al describes a catalytic dewaxing process employing a zeolite as catalyst and is herein incorporated by reference. U.S. Pat. No. 4,137,148, also incorporated by reference, describes hydrotreating oils after catalytic dewaxing.

The prior art reveals a variety of examples of catalytic dewaxing processes employing a fixed bed of crystalline zeolites. U.S. Pat. No. 3,700,585 describes the preparation of zeolites useful in catalytic dewaxing in detail and is hereby incorporated by reference in its entirety. U.S. Pat. No. 3,700,585 describes a catalytic dewaxing process which involves shape selective cracking of hydrocarbons employing zeolites such as ZSM-5 which are described in the patent. U.S. Pat. No. 4,127,148 describes the use of catalytic dewaxing to produce viscous, low pour point specialty oils. A process for the production of lubricating oils is disclosed in U.S. Pat. No. 4,283,272. In this process hydrocarbon feed and hydrogen is passed sequentially through a hydrocracking zone, a catalytic dewaxing zone, and a hydrotreating zone, all at high pressure. The instant invention is directed to diesel fuels rather than lubricating oils, and employs high pressure hydrocracking and low pressure catalytic dewaxing. Furthermore, it is specifically directed to the maximization of cetane number.

The hydrocracker effluent is subjected to catalytic dewaxing in order to achieve a suitably low pour point for the final product. Catalytic dewaxing is suitably carried out in the presence of hydrogen and 400° F. to 1000° F. (205°–538° C.) with a catalyst containing a hydrogenation metal and zeolite ZSM-5 or other intermediate pore size zeolite. The catalytic dewaxing step is operated at pressures between about 200 to about 800 psig, more preferably between about 400 and about 600 psig. The temperature is from about 400° to about 1000° F., more preferably between about 500° F. (260° C.) and 800° F. (427° C.). The LHSV is from about 0.5 to 2.5 vol/vol/hr, more preferably between 1.0 and 1.5 vol/vol/hr. The hydrogen circulation rate is from 1000 to 3000 SCF/BBL, more preferably from 1500 to 2500 SCF/BBL.

The preferred zeolites used for the catalytic dewaxing process are the intermediate pore size zeolites such as ZSM-5, ZSM-11, ZSM-22, ZSM-23 and ZSM-35. These zeolites are characterized by a constraint index of 2–12 as described in U.S. Pat. No. 4,016,218. These zeolites also have a $SiO_2/Al_2O_3$ ratio of at least 12:1.

Constraint Index ($C_1$) values for some typical intermediate pore materials are shown in Table 3 below.

TABLE 3

| Constraint Index | $C_1$ (Test Temperature) |
|---|---|
| ZSM-5 | 6–8.3 (371° C.–316° C.) (700° F.–608° F.) |
| ZSM-11 | 5–8.7 (371° C.–316° C.) (700° F.–608° F.) |
| ZSM-22 | 7.3 (427° C.) (801° F.) |
| ZSM-23 | 9.1 (427° C.) (801° F.) |
| ZSM-35 | 4.5 (454° C.) (849° F.) |

The silica to alumina ratio referred to may be determined by conventional techniques such as temperature programmed ammonia desorption (TPAD). This ratio is meant to represent, as closely as possible, the ratio in the rigid anionic framework of the zeolite crystal and to exclude aluminum in the binder or in cationic or other form within the channels. Although zeolites with a silica to alumina ratio of at least 12 are useful, it is preferred to use zeolites having higher ratios of at least about 30. Such zeolites, after activation, acquire an intracrystal-line sorption capacity for normal hexane which is greater than that for water, i.e., they exhibit "hydrophobic" properties. It is believed that this hydrophobic character is advantageous in the present invention. U.S. Pat. No. 3,702,886 describing and claiming ZSM-5 is incorporated herein by reference.

ZSM-11 is more particularly described in U.S. Pat. No. 3,709,979, the entire contents of which are incorporated herein by reference.

ZSM-12 is more particularly described in U.S. Pat. No. 3,832,449, the entire contents of which are incorporated herein by reference.

ZSM-22 is more particularly described in U.S. Pat. No. 4,556,477 the entire contents of which are incorporated by reference.

ZSM-23 is more particularly described in U.S. Pat. No. 4,222,855, the entire contents of which are incorporated by reference.

Other dewaxing catalysts may also be used for example, zeolite beta (see U.S. Pat. No. 4,419,220, LaPierre) or one of the various silica aluminophosphate (SAPO materials such as SAPO-11 or SAPO-37, as described, for example, in U.S. Pat. No. 5,139,647.

When synthesized in the alkali metal form, the zeolite is conveniently converted to the hydrogen form, generally by intermediate formation of the ammonium form as a result of ammonium ion exchange and calcination of the ammonium form to yield the hydrogen form. In addition to the hydrogen form, other forms of the zeolite wherein the original alkali metal has been reduced to less than about 1.5 percent by weight may be used. Thus, the original alkali metal of the zeolite may be replaced by ion exchange with other suitable ions of Groups IA to VIII of the Periodic Table, including, by way of example, nickel, copper, zinc, palladium, calcium or rare earth metals.

In addition to the crystalline aluminosilicate zeolite component, the dewaxing catalyst includes another material resistant to the temperature and other conditions employed in the process. Such matrix materials include synthetic or naturally occurring substances as well as inorganic materials such as clay, silica and/or metal oxides such as alumina, silica-alumina, silica-magnesia, silica-zirconia, silica-thoria, silica-berylia or silica-titania. The matrix may be in the form of a cogel. The relative proportions of zeolite component and inorganic oxide gel matrix may vary widely with the zeolite content ranging from between about 1 to about 99 percent by weight and more usually in the range of about 5 to about 80 percent by weight of the composite.

The zeolites suitable for catalytic dewaxing maybe modified by a metal or combination of metals selected from Group IB, Group VIB, Group VIIB and Group VIII. These zeolites are preferably modified by a metal or combination of metals selected from the group consisting of nickel, platinum or palladium in the range from about 0.1 to about 5.0 wt. %. The most preferred catalyst is ZSM-5 modified by about 1.0 wt. % Ni.

EXAMPLES

A commonly used feed to the catalytic dewaxer is Arabian Light Atmospheric Gas Oil (LAGO), the properties of which are recited in Table 4. Table 4 also provides the properties of the feed to a high pressure hydrocracker which operates in an extinction recycle mode. The hydrocracker feed is usually a light cycle oil (LCO) obtained from a Fluid Catalytic Cracking Unit (FCC). The properties of the fraction of hydrocracker effluent which boils between 400° and 1000° F. (205° C.–538° C.) is recited in Table 4 as HDC bottoms. The HDC bottoms may be recycled if the hydrocracker is operated in an extinction recycle mode. The properties of two different HDC bottoms, subjected to extinction recycle following one recycle and following two recycles, are included in Table 4. It is notable that the feed to the hydrocracker is considerably richer in sulfur, nitrogen and aromatics than LAGO. After hydrocracking, however, the HDC bottoms exhibit a far lower aromatics content than LAGO. The amount of sulfur and nitrogen present has also been substantially reduced. Recycling further reduces the aromatic and heteroatom content of the HDC Bottoms stream, as Table 4 demonstrates.

Comparative Example 1

Figure 2:
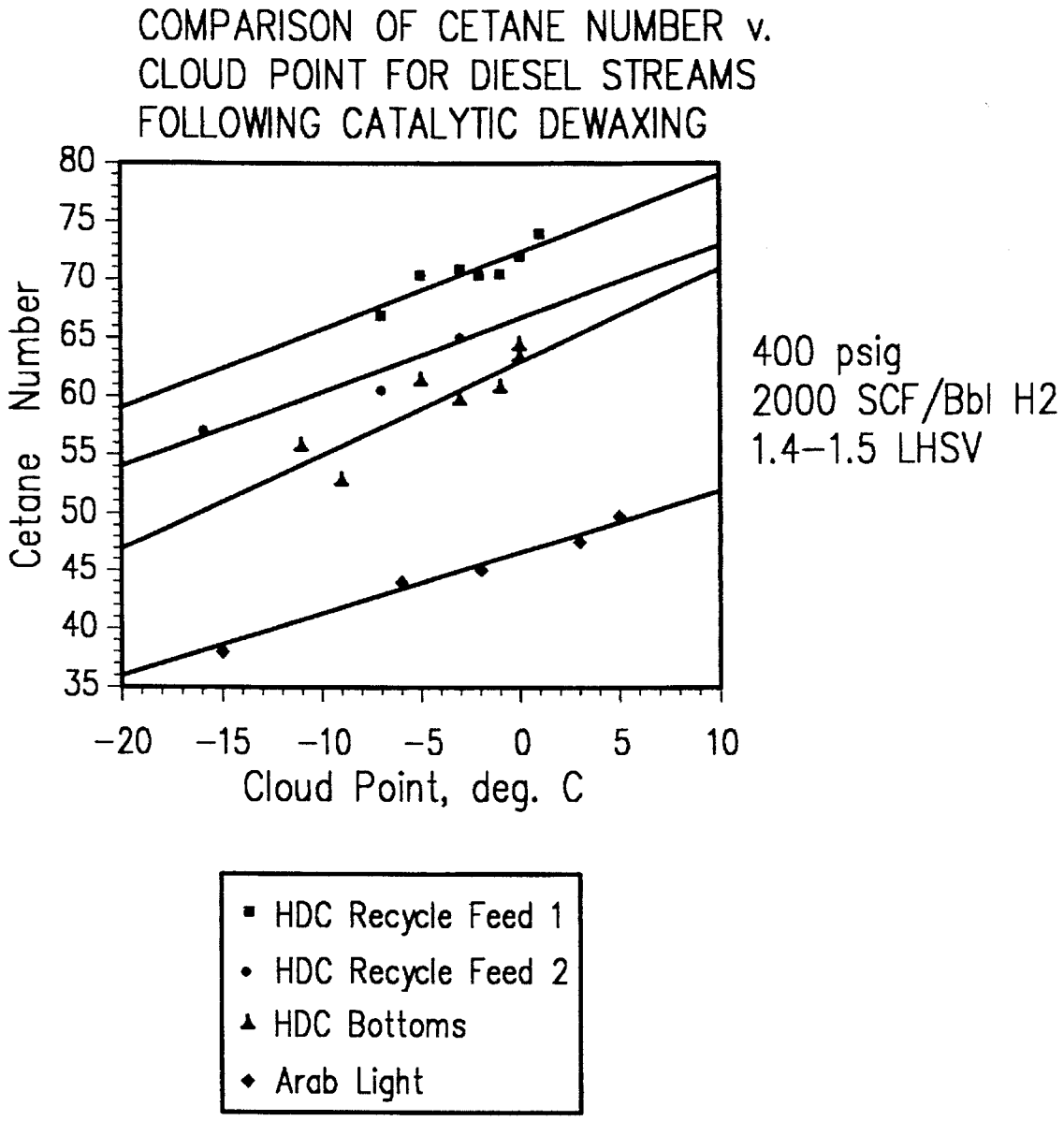
FIG. 2 is a graphical comparison of cetane number v. cloud point for four catalytically dewaxed streams used for diesel fuel.

Table 5 recites the relative properties of specific diesel streams, following catalytic dewaxing. Each stream was produced from a different feed to the catalytic dewaxer. The feeds are HDC bottoms, HDC Recycle Feed 1, HDC Recycle Feed 2, and Arabian Light Atmospheric Gas Oil-(LAGO). The catalytic dewaxing was carried out employing a ZSM-5 catalyst modified by 1 wt. % Ni, under the following conditions: 400 psig pressure, 2000 SCF/Bbl hydrogen, and a space velocity of 1.4–1.5 LHSV. FIG. 2 demonstrates the substantial disparity between the diesel fuel cetane numbers from LAGO and HDC bottoms at specific cloud points. Diesel fuel produced from HDC bottoms has a substantially higher cetane number at constant cloud point than does LAGO, and the disparity increases as cloud point increases. HDC bottoms is thus demonstrated to produce a diesel superior to that produced by dewaxing LAGO.

Comparative Example 2

Table 5 also compares the cetane numbers of HDC bottoms, which are unrecycled, against those of recycled streams. Although unrecycled HDC bottoms may be catalytically dewaxed to produce a diesel of higher cetane number than that of LAGO, it is evident that cetane number (and therefore diesel quality) at constant cloud point increases when HDC bottoms are recycled. This effect is demonstrated graphically in FIG. 3.

TABLE 4

| | RELEVANT PROPERTIES OF SPECIFIC STREAMS | | | | |
|---|---|---|---|---|---|
| | Feed to the Hydrocracker | Arab Light LAGO | HDC Bottoms | HDC Recycle Feed No. 1 | HDC Recycle Feed No. 2 |
| H, wt % | 11.57 | 13.29 | 14.59 | 13.49 | 14.88 |
| S, wt % | 1.60 | 1.20 | <0.02 | <0.002 | <0.002 |
| N, ppm | 700 | 110 | 1 | <23 | <1 |
| Specific Gravity, g/mL | 0.912 | 0.850 | 0.817 | 0.796 | 0.796 |
| API | 23.6 | 35.0 | 42.0 | 46.2 | 46.2 |
| Cloud Pt, °F./°C. | — | 36/2 | 50/10 | 41/5 | 35/2 |
| Aromatics | 57.0 | 29.1 | 5.8 | 1.4 | <1.5 |
| Distillation, °F. % | | | | | |
| 5 | 235 | 401 | 458 | 456 | 496 |
| 10 | — | 453 | 472 | 469 | 510 |
| 20 | — | 492 | 491 | 490 | 544 |
| 50 | 583 | 576 | 550 | 574 | 618 |
| 70 | — | 625 | 604 | 603 | 656 |

TABLE 4-continued

| | RELEVANT PROPERTIES OF SPECIFIC STREAMS | | | | |
|---|---|---|---|---|---|
| | Feed to the Hydrocracker | Arab Light LAGO | HDC Bottoms | HDC Recycle Feed No. 1 | HDC Recycle Feed No. 2 |
| 90 | — | 759 | 679 | 710 | 759 |
| 95 | 880 | 791 | 716 | 756 | 776 |

TABLE 5

RELATIVE PROPERTIES OF DIESEL STREAMS FOLLOWING CATALYTIC DEWAXING

| | HDC Recycle Feed 1 | | | | | | | HDC Recycle Feed 2 | | | |
|---|---|---|---|---|---|---|---|---|---|---|---|
| Temperature °F. | 493 | 502 | 511 | 520 | 523 | 532 | 538 | 464 | 482 | 500 | 518 |
| Temperature °C. | 256 | 261 | 266 | 271 | 273 | 278 | 281 | 240 | 250 | 260 | 270 |
| Cloud Pt., °C.* | 1 | 0 | −1 | −2 | −3 | −5 | −7 | −1 | −3 | −7 | −16 |
| CN(NMR) | 74 | 72 | 70 | 70 | 71 | 70 | 67 | 70 | 65 | 61 | 57 |
| HDC Bottoms | | | | | | | | Arab Light LAGO | | | |
| Temperature °F. | 518 | 536 | 554 | 572 | 590 | 469 | 482 | 491 | 500 | 518 | 527 | 536 |
| Temperature °C. | 270 | 280 | 290 | 300 | 310 | 243 | 250 | 255 | 260 | 270 | 275 | 280 |
| Cloud Pt., °C.* | 5 | 3 | −1 | −6 | −15 | 0 | 0 | −3 | −1 | −5 | −9 | −11 |
| CN(NMR) | 49 | 47 | 45 | 44 | 38 | — | — | — | — | — | — | — |
| Cetane Number | | | | | | 64 | 63 | 59 | 60 | 61 | 53 | 56 |

*400 psig, 2000 SCF/BBL $HV_2$, 1.4–1.5 LHSV

What is claimed is:

1. A process for producing a high cetane diesel fuel having a cetane number of at least 55 at less than or equal to 41° F. cloud point, the process comprising the following steps:

(a) hydrocracking a highly aromatic, substantially dealkylated hydrocarbon feed produced by the catalytic cracking of a hydrocarbon fraction, the feed boiling at a temperature greater than about 235° F., the feed having an aromatic content of at least 30 weight percent at a hydrogen partial pressure of from about 1500 psig to about 3000 psig to form a hydrocracked product fraction boiling between about 400 to about 1000° F., having an API gravity of at least 40, a sulfur content of not more than 1 wt % wherein the hydrocracking is conducted in the presence of a large pore size zeolite catalyst having acidic and hydrogenation-dehydrogenation functionality;

(b) catalytically dewaxing the fraction of the HDC effluent boiling between 400° F. and 1000° F. by passing said fraction over a fixed bed of dewaxing catalyst wherein the dewaxing catalyst consists essentially of an intermediate pore size zeolite and binder, at conditions comprising a range of from 200 to 800 psig, from 1000 to 3000 SCF/BBL $H_2$, a space velocity from 0.5 to 2.5 LHSV, and a temperature from 400° to 1000° F. to obtain a diesel fuel.

2. The process of claim 1, wherein the feed of step 1(a) boils at a temperature greater than about 400° F.

3. A process according to claim 1 in which the feed to the hydrocracker comprises a catalytic cracking cycle oil.

4. A process according to claim 1 in which the feed to the hydrocracker has a hydrogen content of 10 to 16 weight percent.

5. A process according to claim 1 in which the feed to the hydrocracker has an API gravity of 5 to 25.

6. A process according to claim 1 in which the large pore zeolite catalyst is selected from the group consisting of zeolite beta, ZSM-4, ZSM-20, TEA Mordenite, Mordenite.

7. A process according to claim 1 in which the hydrogenation-dehydrogenation functionality of the large pore size zeolite is provided by at least one metal component selected from the group consisting of nickel, tungsten, vanadium, molybdenum, cobalt and chromium.

8. A process according to claim 1 in which the feed to the hydrocracker comprises a catalytic cracking cycle oil having an end point of not more than 750° F.

9. A process according to claim 1, in which the conditions for catalytic dewaxing comprises catalytically dewaxing the fraction of the HDC effluent boiling between about 400° and about 1000° F. by passing the fraction over a fixed bed of dewaxing catalyst at conditions comprising a range of from 400 to 600 psig, from 1500 to 2500 SCF/BBL $H_2$, a space velocity from about 1.0 to 1.5 LHSV, and a temperature from 500° to 800° F. to obtain a diesel fuel.

10. The process of claim 8 in which the intermediate pore size zeolite employed in the catalytic dewaxing step is selected from the group consisting of ZSM-5, ZSM-11, ZSM-22, ZSM-23 and ZSM-35.

11. A process according to claim 1 in which the intermediate pore size zeolite employed in the catalytic dewaxing step possesses a Constraint Index of at least 2 and no more than 12.

12. The process of claim 9, in which the intermediate pore size zeolite employed is modified by at least one metal selected from Group IB, Group VIB, Group VIIB and Group VIII.

13. The process of claim 9, in which the intermediate pore size zeolite employed in the catalytic dewaxing step is modified by the addition of at least one metal selected from the group consisting of nickel, platinum, and palladium.

14. The process of claim 13, in which the catalyst employed in the catalytic dewaxing step is NiZSM-5, wherein the Ni content is no greater than 1 wt. %.

15. A process for producing a high cetane diesel fuel having a cetane number of at least 55 at less than or equal to 41° F., cloud point, the process comprising the following steps:

(a) hydrocracking a highly aromatic, substantially dealkylated hydrocarbon feed produced by the catalytic cracking of a hydrocarbon fraction, the feed boiling at a temperature greater than about 235° F., the feed having aromatic content of at least 30 weight percent at a hydrogen partial pressure of from about 1500 psig to about 3000 psig to form a hydrocracked product fraction boiling between about 400° to 1000° F., the bottoms fraction, having an API gravity of at least about 40, a sulfur content of not more than 1 wt. %, wherein the hydrocracking is conducted in the presence of a large pore size zeolite catalyst having acidic and hydrogenation-dehydrogenation functionality;

(b) passing all or a portion of the hydrocracked product fraction of part (a) through an extinction recycle process in order to convert the fraction to desirable products, the process comprising the following steps:

(1) passing the material to be recycled into a high pressure separator, which operates at a pressure of at least 1000 psig, where gaseous components are removed;

(2) passing all or a portion of the material of part (1) after removal of gases to a lower pressure separator operating at a pressure of between 200 and 800 psig, wherein the lighter liquid components, boiling below 400° F. are removed from the heavy portion of the material boiling between about 400° to 1000° F.;

(3) passing all or part of the heavy portion of step (2) to a second stage hydrocracker, where it undergoes cracking at a hydrogen partial pressure of from about 1500 psig to about 3000 psig;

(4) passing the effluent of the second stage hydrocracker to a high pressure separator which operates at a hydrogen partial pressure of from about 1500 psig to about 3000 psig where gaseous components are removed;

(5) passing the fraction of second stage hydrocracker effluent remaining after the gaseous removal of step (4) to the low pressure separator of step (2), from which the heavy portion of the second stage hydrocracker effluent is boiling between about 400° to 1000° F. recycled to the second stage hydrocracker or passed to the catalytic dewaxing unit;

(c) catalytically dewaxing the fraction of the HDC effluent boiling between 400° and 1000° F. by passing the fraction over a fixed bed of dewaxing catalyst wherein the dewaxing catalyst consists essentially of an intermediate pore size zeolite and binder, at conditions comprising a range of from 200 to 800 psig, from 1000 to 3000 SCF/BBL $H_2$ a space velocity from 0.5 to 2.5 LHSV, and a temperature from 400° to 1000° F. to obtain diesel fuel.

16. A process for producing a high cetane diesel fuel having a cetane number of at least 55 at less than or equal to 41° F. cloud point, the process comprising the following steps:

(a) hydrocracking a highly aromatic, substantially dealkylated hydrocarbon feed produced by the catalytic cracking of a hydrocarbon fraction, the feed boiling at a temperature greater than about 235° F., having aromatic content of at least 30 wt. % at a hydrogen partial pressure of from about 1500 psig to about 3000 psig to form a hydrocracked product fraction boiling between about 400° to about 1000° F., having an API gravity of at least 40, sulfur content of not more than 1wt. %, wherein the hydrocracking is conducted in the presence of a large pore zeolite catalyst having acidic and hydrogenation-dehydrogenation functionality;

(b) recycling a portion of the fraction boiling between 400° and 1000° F. to the hydrocracking step (a);

(c) catalytically dewaxing the portion of the fraction of step (a) boiling between 400° and 1000° F. which is not recycled in step (b) by passing the fraction over a fixed bed of dewaxing catalyst wherein the dewaxing catalyst consists essentially of an intermediate pore zeolite and binder, at conditions comprising a range of from 200 to 800 psig, from 1000 to 3000 SCF/Bbl $H_2$, a space velocity from 0.5 to 2.5 LHSV, and a temperature from 400° to 1000° F. to obtain a diesel fuel.

17. A process for producing a high cetane diesel fuel having a cetane number of at least 55 at less than or equal to 41° F. cloud point, the process comprising the following steps:

(a) hydrocracking a highly aromatic, substantially dealkylated hydrocarbon feed produced by the catalytic cracking of a hydrocarbon fraction, the feed boiling at a temperature greater than about 235° F., having aromatic content of at least 30 wt. % at a hydrogen partial pressure of from about 1500 psig to about 3000 psig to form a hydrocracked product fraction boiling between about 400° to about 1000° F., having an API gravity of at least 40, sulfur content of not more than 1 wt. %, wherein the hydrocracking is conducted in the presence of a large pore zeolite catalyst having acidic and hydrogenation-dehydrogenation functionality;

(b) passing all or a portion of the hydrocracked product fraction of part (a), which boils between about 400° to about 1000° F., through an extinction recycle process in order to convert the fraction to desirable products, the process comprising the following steps:

(1) passing the material to be recycled to a hydrocracker, where it undergoes cracking at a hydrogen partial pressure of from about 1500 psig to about 3000 psig, producing a lighter fraction which boils below 400° F. and a heavier fraction, which boils between 400° and 1000° F.;

(2) recycling a portion of the heavier fraction of step (1) to the hydrocracker of step (1) or passing the portion to step (c);

(c) catalytically dewaxing material boiling between 400° and 1000° F. obtained from either step (a) or (b) by passing the material over a fixed bed of dewaxing catalyst wherein the dewaxing catalyst consists essentially of an intermediate pore zeolite and binder, at conditions comprising a range of from 200 to 800 psig, from 1000 to 3000 SCF/Bbl $H_2$, a space velocity from 0.5 to 2.5 LHSV, and a temperature from 400° to 1000° F. to obtain a diesel fuel.

* * * * *